United States Patent [19]

Taira et al.

[11] 4,339,941

[45] Jul. 20, 1982

[54] METHOD AND APPARATUS FOR PRODUCING THICK WELDED STEEL PIPE

[75] Inventors: Tadaaki Taira; Toshio Ishihara; Hiromichi Itoshima, all of Fukuyama; Yutaka Mihara, Tokyo; Takashi Kogawa, Kawasaki, all of Japan

[73] Assignee: Nippon Kokan Kabushiki Kaisha, Tokyo, Japan

[21] Appl. No.: 148,501

[22] Filed: May 9, 1980

[30] Foreign Application Priority Data

May 22, 1979 [JP] Japan ..... 54-62244

[51] Int. Cl.[3] ..... B21D 37/10

[52] U.S. Cl. ..... 72/412; 72/367; 72/416

[58] Field of Search ..... 72/412, 404, 416, 367, 72/368

[56] References Cited

U.S. PATENT DOCUMENTS

| | | | |
|---|---|---|---|
| 977,118 | 11/1910 | Minshull | 72/379 |
| 1,879,077 | 9/1932 | Carlsen | 72/368 |
| 1,879,078 | 9/1932 | Carlsen | 72/368 |
| 2,889,866 | 6/1959 | Braun | 72/416 |
| 3,253,452 | 5/1966 | Scott | 72/368 |

*Primary Examiner*—Gene Crosby

*Attorney, Agent, or Firm*—Frishauf, Holtz, Goodman and Woodward

[57] ABSTRACT

For producing steel pipe from thick steel plate, a foreign member is arranged on a die at the center of its caliber in the length thereof such that the member meets the edge groove of the steel, and in such a condition O-ing is carried out thereon, thereby to produce a thick welded pipe having very little the peaking amount.

29 Claims, 27 Drawing Figures

METHOD AND APPARATUS FOR PRODUCING THICK WELDED STEEL PIPE

BACKGROUND OF THE INVENTION

The invention relates to a method of producing thick welded steel pipes and an apparatus for effectively reducing the method to practice. The method and apparatus enables making thick welded steel pipes without the peaking amount on the edge preparation.

The UOE process is a known method for producing thick welded steel pipes. This method in general comprises preparing the steel plate by means of an edge planer to provide edges suitable to a diameter of a pipe to be formed and to the welding process, carrying out an edge-bending process on the edges, forming the steel into a U-shape through a U-ing press, and performing O-ing by means of an O-ing press on the U-shaped pipe-blank to form it into a pipe by means of an upper die and a lower die on a circular caliber. Subsequently, after a washing process, the O-shaped pipe-blank is subjected to a tack welding, and to an inner surface welding and an outer surface welding, followed by expanding the pipe by means of a mechanical expander.

The UOE process has been broadly used for producing steel pipes of large diameter. However, it has been inevitably involved with the occurrence of peaking in the case of a thick wall and high strength steel pipe such as deep-sea pipeline which has been recently desired, for example the thick steel pipe being API X65 and more than 2% in t/D (t: thickness and D: diameter).

The peaking is defined as a delta in FIG. 1 of projection from the regular circle Q, and not only should it be avoided in view of the product value but also it brings about instability on joining faces at welding after the O-ing, resulting in causing defects in the weld. Further, the peaking remaining after welding generates large angular distortion on the seam part during the sizing process during the expansion of the pipe and causes so-called expansion cracks.

Therefore, in the UOE piper production this peaking should be reduced as much as possible. However, due to under mentioned circumstances, a large amount of peaking has been inevitable in the prior art. That is, the UOE process treats as said above the edges of the plate with the edge bending process by the crimping press before entering the pipe-making stage. This bending basically depends upon the bending moment $M_0=F.L$ between two points F and F as in FIG. 2. In order to bend the vicinity of the edges ($L\rightarrow 0$), a load F for obtaining the constant moment $M_0$ becomes infinite theoretically. Therefore 1.0 to 1.5t of thickness t generally remains as non-processed, i.e., linear, thus causing peaking. FIG. 3 shows the peaking after O-ing which has been subjected to the edge-bending by means of the crimping press of 1500t. It is noted that the higher becomes the peaking, the higher are the thickness and the strength ("X65" and "X42" mean the strength grade of the pipe). As mentioned above, the main cause of the peaking is the undeformed straight part of a crimped edge. The peaking can be more or less reduced by a compressive process during O-ing. The mechanism of reducing the peaking is the buckling phenomena as shown in FIG. 4. In such case, a great load is required in order to bend the crimped edge because the moment arm (L) is very short. That is, the above mentioned method to reduce the peaking is not so effective although a great O-ing load is required. The conventional O-ing process is performed as shown in FIG. 5 by operating an upper die 1 and a lower die 2, having hemispherical upper and lower calibers 1*a*, 1*b*. In this case, as shown in FIG. 6 the steel plate 6 held between the upper and lower dies 1, 2 pressed by the O-press power $P_0$, is bent by force F transmitted thereto in the circumferential direction, so that undeformed parts 61, 61 of the crimped edge are deformed along the die caliber 1*a*, 1*b*. The load $P_1$ required for buckling is described by the following equation.

$$P_1=n_1\cdot\pi^2\cdot E\cdot t^3\cdot L/h$$

wherein,

E is Young's modulus

L is the length of the pipe h is the length of the undeformed part of crimped edge $n_1$ is a constant On the other hand, the following equation expresses the power $P_2$ needed for the bending process before the compressing of the O-ing.

$$P_2=n_2\cdot t\cdot L\cdot\sigma_z$$

wherein, $\sigma_z$ is deformation resistance of the material $N_2$ is a constant As noted from both expressions, the load $P_1$ (buckling load of the undeformed parts) is proportional to the cube of the wall thickness t, and in comparing of $P_1$ with $P_2$, $P_1$ is greater. FIG. 7 shows a representative example of a stroke vs load curve during the O-ing. The load of an area B corresponding to the compressing process is overwhelmingly larger than the load of an area A corresponding to the bending process, and therefore, in the prior art, it is impossible to reduce the peaking of the thick pipe, leaving aside the case of a thin pipe, in view of the facilities. The prior art has not been able to produce a thick pipe of API X65 where t/D exceeds 5%.

Such a problem is not particular to the UOE process, but exists in the production of thick wall steel pipe according to other processes, for example, the bending roll, cage forming, or bending press systems.

The present invention has been devised to eliminate those problems involved in the existing production of thick steel pipe.

It is a main object of the invention to offer a method which subjects to edge-bending the edge parts of the thick steel plate which have not been sufficiently processed with the edge-bending and remain as non-processed linear, in the O-ing press by means of a simple structure and at low force, thereby to control the peaking occurrence to be as little as possible.

It is another object of the invention to offer a thick steel pipe of large diameter and which is excellent in shape and of high quality by reducing the peaking to the minimum.

It is a further object of the invention to offer an apparatus which enables economically practicing the edge-bending of the steel plate by means of a simple facility.

Many other features and advantages of the invention will be apparent from the following description of the preferred embodiments of the invention as shown in the attached drawings.

DETAILED DESCRIPTION OF PREFERRED EMBODIMENTS

Figure 10:
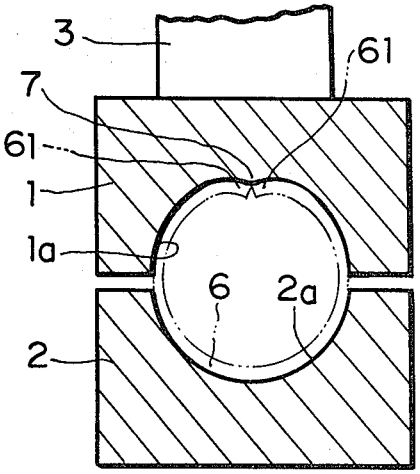
FIG. 10 is an explanatory view showing the O-ing dies and the O-shaped condition in the method of the present invention.
Figure 11:
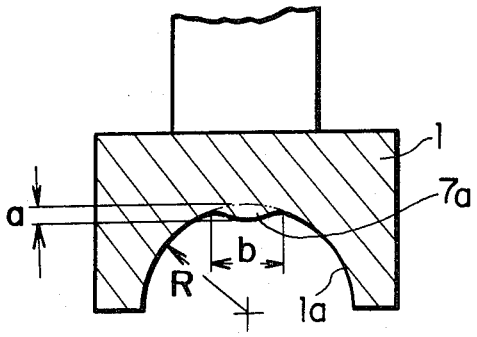
FIG. 11 is a cross sectional view showing one example of an upper die in the method of the present invention.

Reference will be made to the UOE process for explaining the embodiments of the present invention. In the case of manufacturing the pipe by the UOE process, the plate is edge-treated and formed in a U-shaped pipe-blank and then put into an O-ing press as mentioned before. The O-ing is performed with the lower dies 2 and the upper dies 1 connected to a piston rod 3 of a pressing cylinder, which dies are made in blocks of appropriate number. See FIGS. 8–10. The upper die 1 is elevated (FIG. 8) and the U-shaped blank 6*a* is put on the lower die 2. The upper die 1 is lowered at a determined pressure until both dies 1, 2 contact, i.e., until blank 6*a* is compressed into an O-shape, as seen in FIG. 9. In such a way, the U-shaped blank 6*a* is almost formed into the O-shape along the curvature of the respective hemispherical calibers 1*a*, 2*a*. The normal thin steel of low strength is finished in the O-ing at this step, but thick steel dealt with in this invention still has large peaking in the vicinity of the edge-groove 5. The present invention positions a foreign member 7 at the place corresponding to the edge groove 5 of the pipe 6 along the length of the die. The foreign member 7 may be as shown in FIG. 10 an integral projection on the top of the semi-circular caliber 1*a* of the upper die 1 along the length direction thereof, and the U-shaped pipe-blank 6*a* is formed into the O-shape by the specially shaped upper die 1 and the lower die 2 (which is sufficient with the same circular caliber as a conventional lower die). The place for the foreign member 7 is an area where the peaking is taken up as a problem, and as shown in FIG. 11 the width (b), the height (a) and the ratio a/R (R is the radius of the die) should be appropriately determined, taking into consideration the the outer diameter, the thickness, and the strength characteristics of the steel pipe and the compression by the O-ing press so that the steel pipe, even after with spring-back after the O-ing, is provided with a determined curvature. One example is as the width (b): 50 to 550 mm, the height (a): 5 to 50 mm and a/R: 0.01 to 0.08. In any case, the top and both sides are continued with a smooth curve line.

Figure 12:
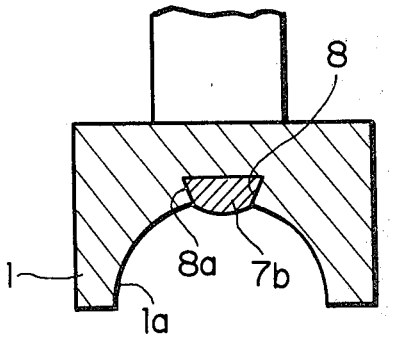
FIGS. 12 to 14 are cross sectional views showing other embodiments of upper dies of the invention.

FIG. 11 to FIG. 14 show respective embodiments of the foreign members 7 on the upper die 1. FIG. 11 shows that the foreign member 7*a* is integrally formed with die 1 by casting or pad-welding. FIG. 12 shows an emodiment where the foreign member 7*b* is not fixed but is exchangeable, the upper die in the position corresponding to the top of the caliber 1*a* being formed with a dovetail groove 8 for receiving the member 7 which is also formed with a dovetail shape 8*a* for reception in said dovetail groove 8. This embodiment enables easy changing of the shape and size of the foreign member 7*b* in accordance with various conditions such as the outside diameter, thickness, properties and and others of the steel pipe.

Figure 13:
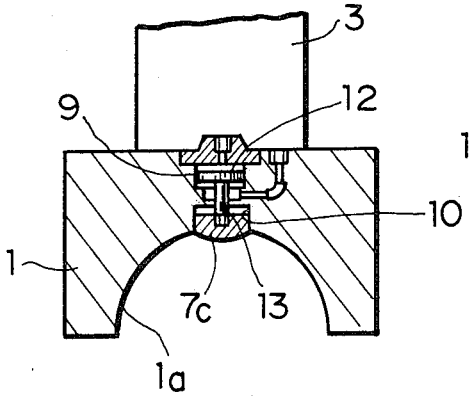
Figure 14:
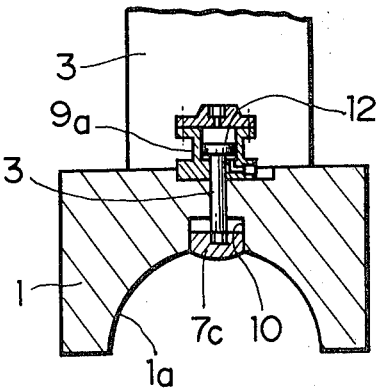

In FIG. 13 and FIG. 14, the foreign member 7*c* is movable in the radial direction of the die by means of a compressing cylinder 9 for the O-press and a pressing cylinder 9*a*. FIG. 13 shows the embodiment where the upper die has at the top of the caliber 1*a* a sliding groove 10 to insert the member 7*c* therein. A cylinder chamber is provided at a rear part of the groove 10 so that a rod 13 of a piston 12 inserted in the cylinder member is connected to a rear part of the member 7*c*.

FIG. 14 shows the embodiment where the cylinder is not housed as seen in FIG. 13 but a cylinder 9*a* is secured to outside of the upper die 1 and a piston rod 13 depending from a piston 12 in the cylinder 9*a* is inserted into the die and the piston rod 13 is connected to the member 7*c* mounted in the sliding groove 10. In any of the embodiments in FIG. 13 and FIG. 14, the cylinders 9, 9*a* are each positioned or plurally positioned per block of the upper die 1. Since in such a system, the O-ing is double-acting and the inserting amount of the foreign member *7c* may be controlled at will, the shape after the spring-back of the pipe is easily controlled in accordance with the material properties, the outside diameter and the thickness, and further dispersions of the peaking amount in the length of the pipe can be cancelled and made uniform.

In the above embodiment, the foreign member 7 is put on the top of the caliber 1*a* of the upper die 1 and the U-shaped pipe-blank 6*a* is placed on the lower die 2 having the normal circular caliber 2*a*, and in such a condition the upper die 1 is lowered to bend the plate 6*a* into a circular shape between the calibers 1*a*, 2*a* of the upper and lower dies 1, 2. The undeformed part (straight parts) in the crimping and the U-ing steps reach to the top of the caliber 1*a* of the upper die 1 by the pressure of the die 1. At this time, since the top of the caliber is formed with the foreign member 7 projecting inwardly, the undeformed parts 61, 61 are added successively with the bending moment in the thickness as shown with the phantom lines in FIG. 10 during reaching the top from the both sides of the member 7 so that the edge parts of the plate become curled inwardly. However, these parts have a determined curvature by the spring-back caused by releasing the pressure. The undeformed parts 61 are processed efficiently since they do not depend on the compressing bend by the force transmitted in the circumference of the steel pipe as conventionally, and excessive power is not required for the deformation and the peaking amount can be reduced easily and exactly.

The embodiments in FIG. 13 and FIG. 14 draw in the member *7c* by the compressive cylinders 9, 9*a* during the initial bending period of the O-ing, and when the undeformed parts 61, 61 come to the top of the caliber, the cylinders 9, 9 project the member 7 to desired height of the member. The peaking after the spring-back can be minimized by controlling the projecting amount of the member 7.

Experimental examples according to the above embodiments are given below.

EXPERIMENTAL EXAMPLE 1

I. The O-ing press was carried out for manufacturing thick steel pipe of API X65 and size of 24"×1". The upper die was of the foreign member-exchanging type as shown in FIG. 12 in which the caliber radius R was 12", the height (a) of the foreign member was 15.2 mm, the width (b) was 100 mm and a/R was about 5%.

II. The peaking amount was about 0.2 mm after the O-ing press in the above condition. On the other hand, for comparison with the present invention, the O-ing was carried out according to the conventional process under the condition that the circular caliber radius of the upper die was 12". The peaking amount thereby was about 4.2 mm. The present invention thus has a remarkable effect in reducing the peaking.

Figure 15:
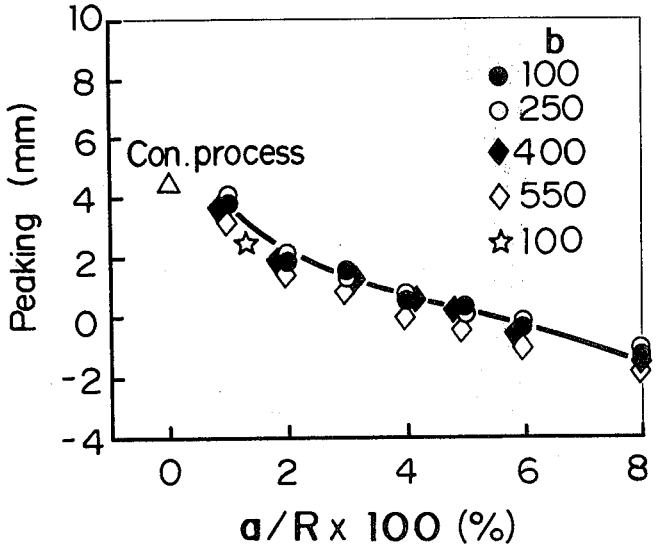
FIG. 15 is a graph showing the relation between the peaking and the dimensions of a foreign member.

III. In the invention the O-ing steps were carried out between 1 and 8% of a/R and with the widths (b) of the members 7 being 100 mm, 250 mm, 400 mm and 550 mm. FIG. 15 shows the results.

EXPERIMENTAL EXAMPLE 2

Figure 16:
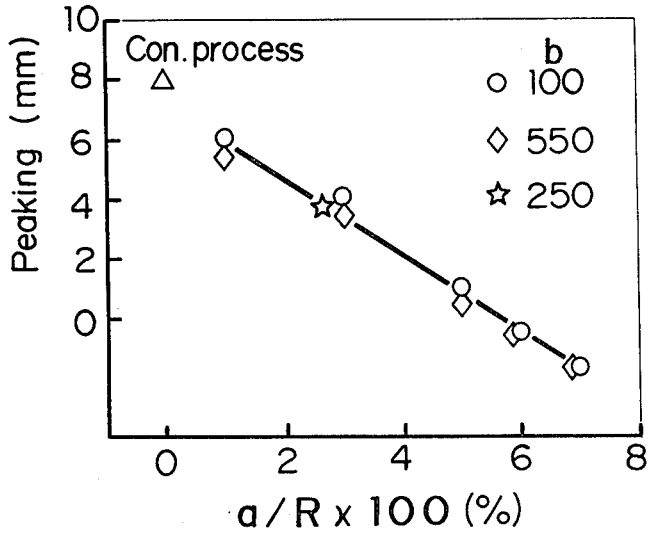
FIG. 16 is a graph showing the relation in FIG. 15 for different sizes of the steel pipe.

The O-ing was carried out for producing thick steel pipe of API X65 and size of 40"×1.5" with a/R between 0 (the conventional process) and 7% and the foreign member widths (b) were 100 mm and 550 mm. FIG. 16 shows the results. The peaking amount according to the conventional process was 8 mm while the present invention reduced it remarkably.

As is apparent from FIG. 15 and FIG. 16, in the inventive process the peaking amount is reduced as a/R increases. When a peaking amount of not more than 2 mm is desired as the absolute value, a/R may be determined in the range between 4 and 7%, and further it is seen that the width (b) of the foreign member has little influence. From these fact, it may be said that when the outside diameter is 16" to 64", a=5 to 50 mm and b=50 to 400 mm are desired, and when the caliber radius R is 12", a=12 to 21 mm is desired, and when R is 24", a=24 to 42.6 mm is desired and when R is 32", a=32 to 56.9 is desired.

Figure 17:
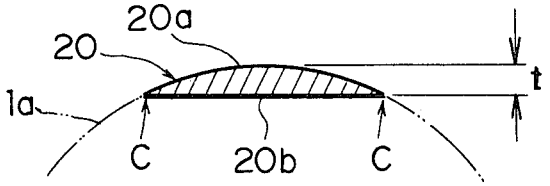
FIG. 17 is a cross sectional view showing one example of a shim member to be employed in this invention.
Figure 18:
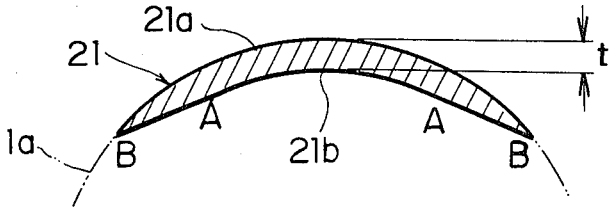
FIG. 18 is a cross sectional view showing another embodiment.
Figure 22:
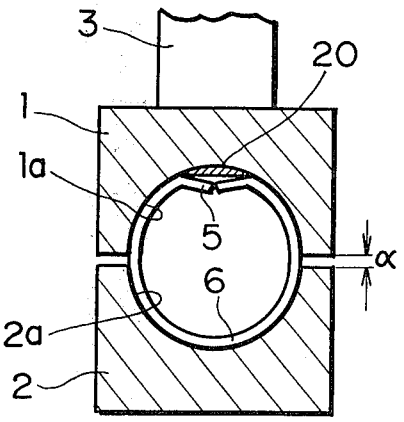
FIG. 22 is an explanatory view showing finishing by a final O-ing.

FIG. 17 and FIG. 22 show other embodiments using a shim as the foreign member. FIG. 17 and FIG. 18 show shims for effectively practising the present invention. The shim 20 in FIG. 17 is provided with an outer curve 20*a* equal to the curvature of the caliber radius of the upper die 1 (or the lower die 2) and is made flat at a surface 20*b*. The thickness (t) of the shim member 20 is unequal in the width direction so that the flat surface 20*b* compresses the edge groove 5 or the vicinity thereabout of the steel pipe 6. FIG. 18 shows a shim member 21 where the thickness (t) is made almost equal in width with an outer curve 21*a* equal to the curvature of the caliber radius. The surface 21*b* is formed with a curve having the same curvature as the outside diameter of the pipe to be pressed. In this case, it is preferable to prepare a smooth incline on both edges of the shim member 21, i.e., parts from A to B in FIG. 18, in order to prevent scratches on the surface of the pipe.

The above are examples of shim members to replace the foreign member. Other examples may be realized. The thickness and width of the various types of shims may be appropriately selected, taking into consideration the outside diameter, thickness of the pipe, the strength of the material, the compression ratio of the O-ing and others, such that the shim member is positioned as described and is effective in the O-ing.

Figure 21:
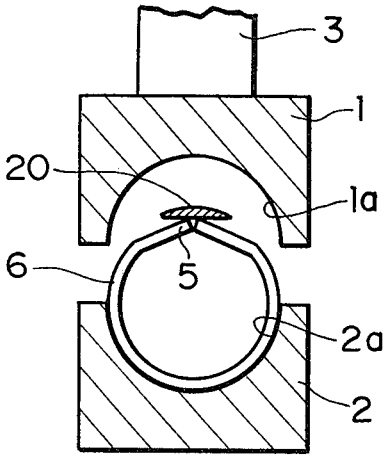
FIG. 21 is an explanatory view showing a condition where the shim member is put on the edge groove of the pipe.

Embodiments using shim members will be explained with reference to FIGS. 17–20. The upper die 1 is lowered as mentioned above to form the U-shaped pipe-blank into the O-shape, and after this, the upper die 1 is once elevated as shown in FIG. 21 and the foreign shim member 20 is put on the edge groove 5 of the pipe 6 longitudinally thereof, followed by lowering the upper die 1 to subject it to O-ing. In this regard, to prevent the shim member 20 from slipping down during the above operation due to its flat surface 26*b* it is formed with a stop projection 20*c* (FIG. 20) in a center portion of its bottom 20*b* in the longitudinal direction for insertion into the edge groove 5 to provide stabilization of the shim.

Figure 1:
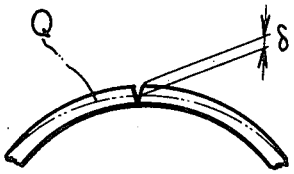
FIG. 1 is an explanatory view showing the peaking of the steel pipe.
Figure 2:
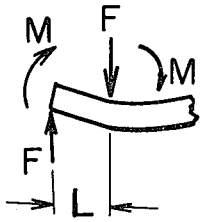
FIG. 2 is an explanatory view showing in principle the edge-bending of the steel plate.
Figure 3:
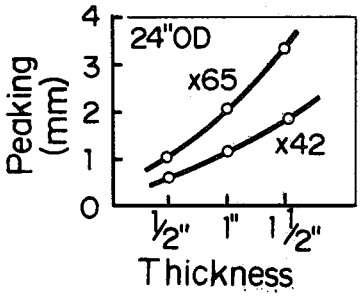
FIG. 3 is a graph showing relation between the thickness of the pipe and the peaking after the O-ing is performed.
Figure 4:
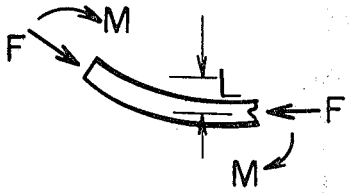
FIG. 4 is an explanatory view showing in principle the edge-bending in the existing O-ing.
Figure 5:
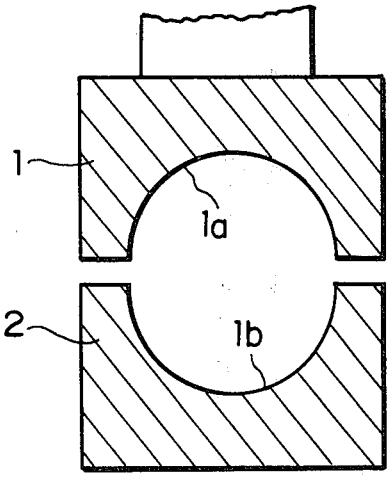
FIG. 5 is a cross sectional view showing dies of the existing O-ing.
Figure 6:
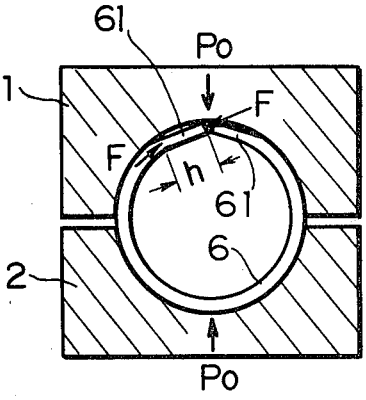
FIG. 6 is an explanatory view showing the existing O-ing condition.
Figure 23:
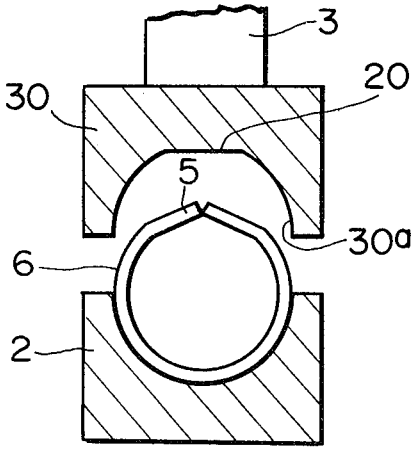
FIG. 23 is an explanatory view showing a condition where the shim member is arranged on the top of the upper caliber along the length thereof.
Figure 24:
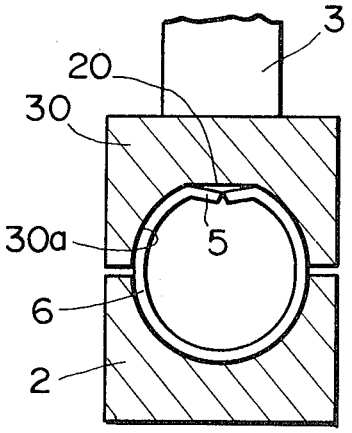
FIG. 24 is an explanatory view showing a condition where the final O-press by the upper die is finished.

When employing the embodiments in FIG. 21 and FIG. 22 it is sufficient to make the shim member separate from the O-ing facility. This embodiment does not preclude providing the shim 20 directly on the upper die. For example, as shown in FIGS. 23 and 24, the shim may be integrally formed on the caliber 30*a* of the upper die 30 at the top of the upper die 30. In this case, the O-ing is first carried out with a conventional upper die such as that of FIG. 5, and the O-ing is again carried out with upper die 30 of FIGS. 23 and 24. In such an embodiment, when the upper die 30 having the shim member 20 is once set, the operation can be successively performed, and it is suitable to mass-production. The shim 20 is not necessarily fixed on the top of the upper die 30 and such a structure is possible that the shim 20 is exchangeable.

Figure 19:
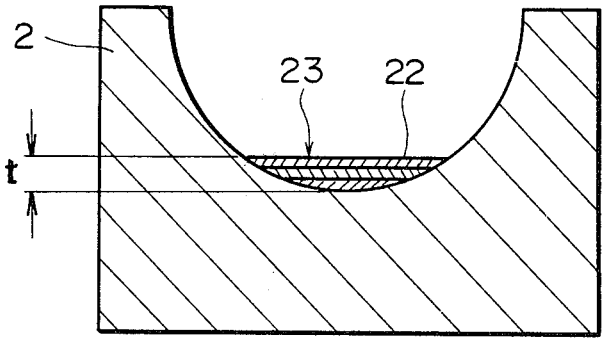
FIG. 19 is a cross sectional view showing a further embodiment of a shim member.
Figure 20:
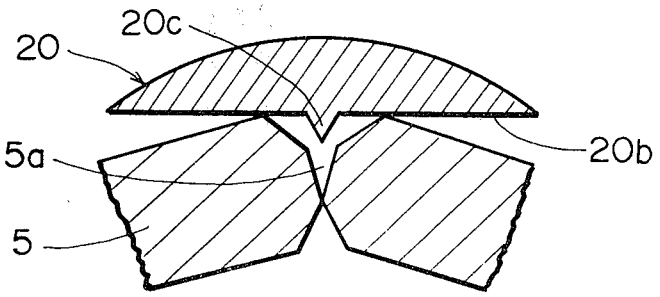
FIG. 20 is an enlarged cross sectional view of a shim member.
Figure 25:
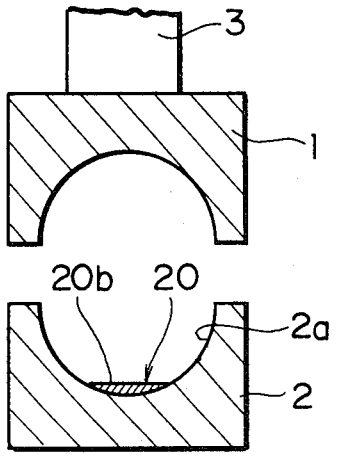
FIG. 25 is an explanatory view showing a condition where the shim member is arranged on the bottom of the die caliber along the length thereof.
Figure 26:
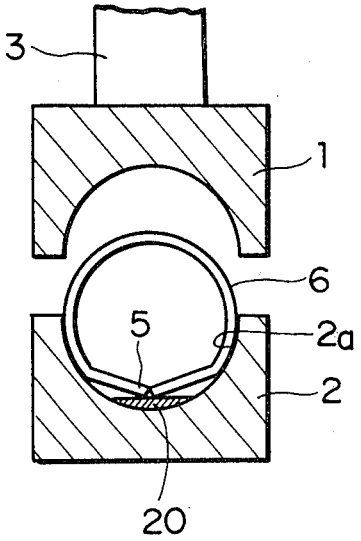
FIG. 26 is an explanatory view showing a condition where the pipe is rotated to meet the shim member at its edge groove on the lower die.
Figure 27:
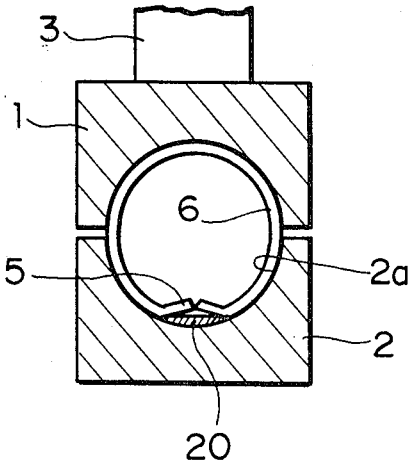
FIG. 27 is an explanatory view showing a condition where the final O-ing press is finished from the condition in FIG. 26.

FIG. 25, FIG. 26 and FIG. 27 show other embodiments in which the shim member 20 is put on the bottom of the caliber 2*a* of the lower die 2. After the O-ing as a pre-process shown in FIG. 9, the upper die 1 is elevated and the steel pipe 6 is held up. The shim 20 is then mounted on the center of the caliber of the lower die 2 as shown in FIG. 25. Then, the steel pipe 6 is set on the lower die 2 as shown in FIG. 26 by rotating the pipe 180° so that the edge groove 5 engages with the shim. In the case of FIG. 25 to FIG. 27, the present invention may provide the same effect as when the shim 20 is arranged on the top of the upper die 1. Although this embodiment requires rotation of the pipe, the successive operation is possible after once setting the shim member 20. Also in this embodiment, the shim member 20 may be integrally provided at the bottom of the lower die 2 or be exchangeable. FIG. 19 shows a further embodiment wherein relatively thin shim plates 22 are superimposed as shown in FIG. 19 to form a laminated foreign shim member 23. In such a manner, the number of shim plates 23 can be increased or decreased to easily control the total thickness (t) of the shim member 23.

When the present O-ing is carried out, it is not always necessary to urge the upper die 1 until it contacts the lower die 2, that is, until a gap ($\alpha$) between the upper and lower dies becomes zero. It is well sufficient that the pressing stroke is determined in accordance with the grade, wall thickness, outside diameter and other characteristics such that the peaking amount becomes minimum as seen by observing the shape in the vicinity of the edge groove 5. The proper thickness of the shim member 20 is generally from about 5 to 30 mm.

Figure 7:
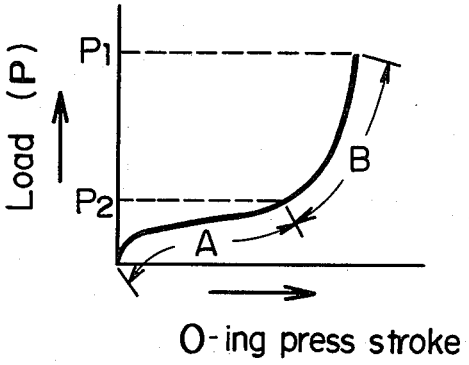
FIG. 7 is a graph showing the relation between the load and the O-ing press stroke in FIG. 6.
Figure 8:
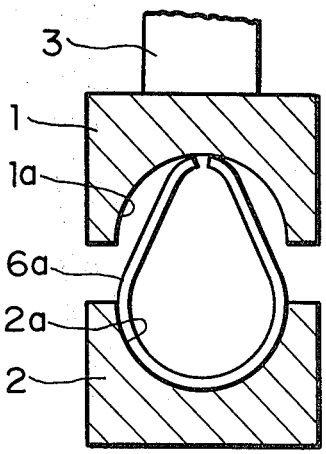
FIG. 8 is an explanatory view showing conditions of the O-shaped pipe-blank and the dies before the O-ing which is a pre-process of the invention.
Figure 9:
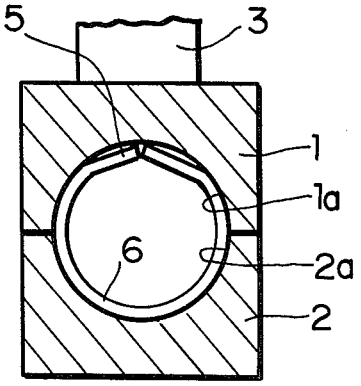
FIG. 9 is an explanatory view showing finishing of the O-ing as the pre-process.

The above mentioned embodiments have referred to the precondition that the steel plate is formed by the O-ing as shown in FIG. 8 and FIG. 9 because the edge parts of the plate are caught or engaged by the edges of the shim 20, i.e., (C) in FIG. 17 or (B) in FIG. 18, and if such catching is absent the pressing may be done initially with the die having the shim 20. In this case, if the O-ing is carried out as the pre-process shown in FIG. 9 scratches will be caused at the contacting part with the shim member 20. However the O-ing in FIG. 9 is for forming the U-shaped blank into the O-shaped blank, and therefore a low compressive load is enough (refer to FIG. 7). Therefore, even if the O-ing of the pre-process is performed, the quality of the product is not remarkably reduced, and if pushing scratches are created, the extent of the scratches will be little. Of course, the steel pipe 6 is rotated to engage the shim 20 with the edge groove 5 as mentioned above.

The aforementioned statement concerns the foreign shim member shown in FIG. 17. The member 21 shown in FIG. 18 is in principle the same in the working effect, and thick steel pipe is made through the UOE process. The present invention is applicable to the pipe-making process which carries out the O-ing in the final step such as the bending roll, the cage-forming or the bending press processes.

Tests were conducted and the amount of peaking was compared between the embodiments shown in FIG. 17 and FIG. 18 and the conventional process. The results are shown in the following table from which it is seen that the peaking amount is remarkably reduced in accordance with the present invention.

| | | | INVENTION | | | |
|---|---|---|---|---|---|---|
| Size | X | Y | A | B | C | D |
| 34" OD × 28mmWT | × 70 | 6.1mm | 9mm | 3mm | 1.0mm | FIG. 17 |
| 32mmWT | × 70 | 5.0mm | 15mm | 8mm | 0.8mm | " |
| 31mmWT | × 80 | 6.6mm | 30mm | 19mm | 1.5mm | " |
| 48" OD × 32mmWT | × 100 | 7.2mm | 9mm | 0mm | 1.5mm | FIG. 18 |

NOTE:
A; Thickness of foreign shim member
B: Gap of O-ing
C: Peaking
D: Shape of foreigner
X: Grade
Y: Peaking at O-ing by conventional process Applying the present invention, pipes of thick wall, high strength and high quality can be produced which cannot be obtained by the conventional UOE process because of the large amount of the peaking.

I claim:

1. A process for producing steel pipe from thick plate material and for reducing the amount of peaking in the pipe during production thereof, comprising:

forming the thick plate into a pipe of generally O-shape by O-ing with a pair of O-ing dies, the O-shaped pipe having two longitudinally extending edges facing each other and forming a longitudinal edge groove therebetween;

locating an inwardly projecting member substantially at the center on an inner caliber of an O-ing die, said projecting member projecting inwardly of said caliber so as to bear on the longitudinally extending outer surfaces of said O-shaped pipe in the vicinity of said facing edges of said O-shaped pipe, said projecting member extending inwardly from the curvature of said caliber and longitudinally in the direction of said edge groove;

engaging said projecting member with said outer surface of said O-shaped pipe in the vicinity of said facing edges of said O-shaped pipe in the vicinity of said edge groove of said O-shaped pipe; and carrying out a further O-ing operation on said pipe with said projecting member in engagement with said outer surfaces of said O-shaped pipe in the vicinity of said edge groove so as to bring said edges together and to reduce peaking in the pipe.

2. The process of claim 1, wherein said projecting member is located on the top of the upper O-ing die caliber.

3. The process of claim 1, wherein said projecting member is located on the bottom of the lower O-ing die caliber.

4. The process of any one of claims 1–3, comprising locating said projecting member over said edge groove.

5. The process of any one of claims 1–3, wherein said projecting member is integrally formed on the die caliber.

6. The process of any one of claims 1–3, wherein said projecting member is removably located in the die caliber.

7. The process of any one of claims 1–3, wherein said projecting member is movable relative to the associated O-ing die in the radial direction of said die.

8. The process of any one of claims 1–3, wherein said projecting member has a substantially flat surface at the part thereof which engages said edge groove of the steel pipe.

9. The process of claim 8, wherein said projecting member is integrally formed on the die caliber.

10. The process of claim 8, wherein said projecting member is removably located in the die caliber.

11. The process of claim 8, wherein said projecting member is movable relative to the associated O-ing die in the radial direction of said die.

12. The process of any one of claims 1–3, wherein said projecting member has a curvature substantially the same as that of the outside diameter of said steel pipe at the points of engagement with the edge groove and portions of the pipe adjacent thereto.

13. The process of any one of claims 1–3, wherein said projecting member has a radially directed projection extending therefrom at the part thereof which contacts said edge groove.

14. The process of any one of claims 1–3, wherein said projecting member comprises a plurality of superimposed layers.

15. Apparatus for producing steel pipe from thick plate material and for reducing the amount of peaking in the pipe during production thereof, comprising:

a first O-ing means for forming the thick plate into a pipe of generally O-shape, said O-ing means including a pair of O-ing dies with mutually facing inwardly curved calibers, the resulting O-shaped pipe having two longitudinally extending edges facing each other and forming a longitudinal edge groove therebetween; and a second O-ing means including a pair of O-ing dies with mutually facing inwardly curved calibers, said second O-ing means further including an inwardly projecting member substantially at the center on an inner caliber of an O-ing die of said second O-ing means, said projecting member extending inwardly from the curvature of said caliber of said O-ing die and extending longitudinally in the direction of said edge groove of said O-shaped pipe, said projecting member being located so as to engage and bear on the outer surface of said O-shaped pipe in the vicinity of said edges which form said edge groove of said O-shaped pipe during an O-ing operation carried out by said second O-ing means;

said O-ing dies and projecting member of said second O-ing means being dimensioned such that when an O-ing operation is carried out on said O-shaped pipe by said second O-ing means with said projecting member in engagement with and bearing on said outer surface of said O-shaped pipe in the vicinity of said edge groove, said projecting member causes bending of said portions of said O-shaped pipe in the vicinity of said edge groove so as to bring said facing edges together and to reduce peaking in the pipe.

16. The apparatus of claim 15 wherein said O-ing means comprises upper and lower dies.

17. The apparatus of claim 16, wherein said projecting member is on a top portion of the upper die caliber.

18. The apparatus of claim 16, wherein said projecting member is on a bottom portion of the lower die caliber.

19. The apparatus of any one of claims 16–18, wherein said projecting member is integrally formed on the respective die caliber from which it extends.

20. The apparatus of any one of claims 16–18, wherein said projecting member is removably coupled to the respective die caliber from which it extends.

21. The apparatus of claim 20, comprising a dovetail groove in the die caliber from which the projecting member extends, and wherein said projecting member has a dovetail thereon for removable engagement with said dovetail groove.

22. The apparatus of any one of claims 16–18, wherein said projecting member is movable relative to the respective caliber from which it extends in the radial direction of the die.

23. The apparatus of claim 22 comprising a slide groove in the die caliber from which said projecting member extends, a cylinder chamber in said die caliber and located rearwardly of said groove, a piston and a rod in said cylinder, and means for connecting the rod with a rear side of said projecting member for moving said projecting member in the radial direction of the die.

24. The apparatus of claim 22, comprising a slide groove in the die caliber from which said projecting member extends for receiving said projecting member therein, a cylinder mounted to an outer side of said die, a piston and piston rod mounted in said cylinder, and means for connecting said piston rod to said projecting member for moving said projecting member relative to said die.

25. The apparatus of any one of claims 16–18, wherein said projecting member is separable from the die between the edge groove of the steel pipe and the surface of the die caliber.

26. The apparatus of claim 25, wherein the surface of said projecting member which engages the edge groove of the steel pipe is substantially flat.

27. The apparatus of claim 26 comprising a stop projection on said projecting member at a center of the bottom thereof which extends longitudinally to improve engagement with said edge groove.

28. The apparatus of claim 25, wherein the surface of said projecting member which engages the edge groove of the pipe has a curvature substantially equal to the outside diameter of the pipe to be produced.

29. The apparatus of any one of claims 16–18, wherein said projecting member comprises a plurality of superposed thin shim layers.

* * * * *

UNITED STATES PATENT AND TRADEMARK OFFICE

CERTIFICATE OF CORRECTION

PATENT NO. : 4,339,941

DATED : July 20, 1982

INVENTOR(S) : Tadaaki TAIRA et al

It is certified that error appears in the above-identified patent and that said Letters Patent is hereby corrected as shown below:

COLUMN 8, line 14, change "D: Shape of Foreigner" to read

--D: Shape of foreign shim member--;

COLUMN 10 (claim 29), line 53, change "claims 16-18" to read

--claims 15-18--.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*